US006679560B1

(12) United States Patent
van Egeraat

(10) Patent No.: US 6,679,560 B1
(45) Date of Patent: Jan. 20, 2004

(54) WHEEL FOR AN IN-LINE SKATE

(75) Inventor: Hendrikus Adrianus van Egeraat, Örebro (SE)

(73) Assignee: PC-VAN Sportartikel GmbH, Bremerhaven (DE)

( * ) Notice: Subject to any disclaimer, the term of this patent is extended or adjusted under 35 U.S.C. 154(b) by 0 days.

(21) Appl. No.: 10/213,792

(22) Filed: Aug. 7, 2002

(51) Int. Cl.[7] ..... B60B 27/00
(52) U.S. Cl. ..... 301/5.306; 301/5.309
(58) Field of Search ..... 301/5.301, 5.302, 301/5.304, 5.306, 5.307, 5.308, 5.309; 152/1, 5, 11, 12, 17, 323

(56) References Cited

U.S. PATENT DOCUMENTS 4,153,303 A * 5/1979 Tanner ..... 301/64.701
4,447,093 A * 5/1984 Cunard et al. ..... 301/64.701
5,028,058 A * 7/1991 Olson ..... 280/11.22
5,538,057 A * 7/1996 Homma et al. ..... 152/7
5,573,309 A 11/1996 Bekessy ..... 301/5.301
5,823,634 A * 10/1998 Pozzobon ..... 301/5.304
6,036,278 A * 3/2000 Boyer ..... 301/5.308
6,135,568 A * 10/2000 Huang ..... 301/5.304

* cited by examiner

*Primary Examiner*—Russell D. Stormer
(74) *Attorney, Agent, or Firm*—Whyte Hirschboeck Dudek SC

(57) ABSTRACT

A wheel for an in-line skate includes a hub having a central stem, two symmetrical upper wings that extend oppositely and sidewisely from the central stem, and two symmetrical lower wings that extend oppositely and sidewisely from the central stem. A solid tire has a hub connecting ring portion that securely embraces and that radially and outwardly extends relative to the upper wings, and a ground engaging ring portion that axially reduces and that radially and outwardly extends from the hub connecting ring portion. The hub connecting ring portion cooperates with the upper wings to form an outer rim of the wheel that is capable of fulcruming about the central stem.

7 Claims, 8 Drawing Sheets

WHEEL FOR AN IN-LINE SKATE

BACKGROUND OF THE INVENTION

1. Field of the Invention

This invention relates to a wheel for an in-line skate, more particularly to a wheel with a hub that has wings which are capable fulcruming about a stem of the hub when an external force is applied to the wings, enlarging the incremental deformation of the tire and conserving its rebound ability under 2. Description of the Related Art FIGS. 1 and 2 illustrate a conventional in-line roller skate wheel 10 disclosed in U.S. Pat. No. 5,573,309. The wheel 10 includes a ring-shaped hub 11 defining a central bore, a pair of opposite bearings 12 mounted in the central bore, and a solid tire 13 mounted on the hub 11. The hub 11 has two opposite cylindrical tire receiving shoulders 111 and a ring-shaped tapered tire deflection controlling rim 112 that extends radially and outwardly and that is tapered from end edges of the shoulders 111. The solid tire 13 includes a rim connecting portion 131 that securely embraces the shoulders 111 and the rim 112, and a ground engaging portion 132 that reduces and that projects radially and outwardly from the rim connecting portion 131.

As illustrated in FIGS. 3 and 4, the conventional wheel 10 is disadvantageous in that the ground engaging portion 132 of the tire 13 flattens when the skater (not shown) tips slightly or sharply (see FIGS. 3 and 4) and pushes against the ground to make a turn, which, in turn, results in an increase in conflicting contact diameters (i.e. a flattening. area) of the ground engaging portion 132 with respect to the ground, and which, in turn, results in sliding of the wheel 10 on the ground and loss of momentum of the wheel 10. Since the hub 11 is substantially non-deformable during the push stroke of the wheel 10, the tire 13 will be deformed under pressure by the hub 11 and the ground especially during the push stroke, thereby resulting in flattening of the ground engaging portion 132 of the tire 13. Wedging the tire section primarily between portions 132 the shoulders 111 and a side of the tire deflection-controlling rim 112, leaving a relative small cross section of material that will allow for incremental deformation. Conventional solid tires are normally made from polyurethane, and are known to have a 10% deformation limit when exposed to pressure such that when the tire is deformed beyond this limit, the incremental stiffness of the same will increase sharply, this contrary to the incremental deformation which, in its turn, will grow very little and results in that the friction area will not grow in relation to the load and sliding of the conventional wheel 10 during the push stroke, especially on moist surfaces. The design for conventional tires normally seeks to compromise the deformation of the tire with rebound ability (or resilient property) of the tire. Rebound ability properties are coupled to how fast the difference between the actual and initial elasticity module (incremental tension force) returns deformations to another or the same shape that belonged to the initial elasticity module. Deformations that approach or exceed 10% of the actual cross section of the tire part under pressure load in the meantime tend to increase the incremental stiffness steeply, but hardly affect the incremental deformation and have hardly any effect on the rebound ability The loads that have hardly any effect on deformation are lost in damping and reduce the rebound ability or recycling of motion energy. The limited tire cross sections of existing tires designs that are wedged between a virtually stiff hub and the ground, allow only for relative small deformations and govern momentum loss via sliding friction, damping, and reduces by its stiffness vibration insulation and roadworthiness whereas more generous incremental deformation would aid rebound ability that would in its term governs the effective use of momentum stored in the tire and give vibration insulation (i.e. protecting a skater from the vibration the wheels generate at ground surface). As such, there is a need for a tire where prolonged incremental deformation keeps the incremental stiffness that low that rebound ability is not compromised. In other words, there is a need for a tire that stops to deform under pressure before the said 10% deformation level is reached, thus staying resilient and at the same time keeps ground contact at a limited number of conflicting contact diameters (i.e. keep the flattening area true to diameter). Invention wise this is solved by deforming the tire under tension as well as pressure and by attaching the tire to a secondary system that will start its rebound ability deforming well before the tire reaches its critical 10% deformation level under pressure. To deform a tire under tension is advantageous as the incremental stiffness that affects the deformability, grows much slower than under deformation by pressure.

SUMMARY OF THE INVENTION

Therefore, the object of the present invention is to provide a wheel for an in-line skate that is capable of overcoming the aforesaid drawbacks of the prior art.

According to the present invention, a wheel for an in-line skate comprises: a ring-shaped hub having a ring-shaped radially extending central stem that has two opposite axial sides and radial inner and outer ends, two symmetrical ring-shaped upper wings that extend oppositely and sidewisely from the radial outer end, and two symmetrical ring-shaped lower wings that extend oppositely and sidewisely from the radial inner end, each of the upper wings having an annular free end and an annular outer surface which extends sidewisely from the central stem to the free end; and a ring-shaped solid tire having a hub connecting ring portion that securely embraces the outer surfaces of the upper wings and that radially and outwardly extends relative to the outer surfaces of the upper wings. The tire further has a ground engaging ring portion that axially reduces and that radially and outwardly extends from the hub connecting ring portion, and that has a radial thickness greater than that of the hub connecting ring portion. The hub connecting ring portion cooperates with the upper wings to form an outer rim of the wheel that is capable of fulcruming about the central stem so as to permit bending of the ground engaging ring portion toward one of the opposite axial sides of the central stem when the wheel tips toward said one of the opposite axial sides of the central stem and pushes against the ground.

BRIEF DESCRIPTION OF THE DRAWINGS

In drawings which illustrate embodiments of the invention.

DETAILED DESCRIPTION OF THE PREFERRED EMBODIMENTS

Figure 1:
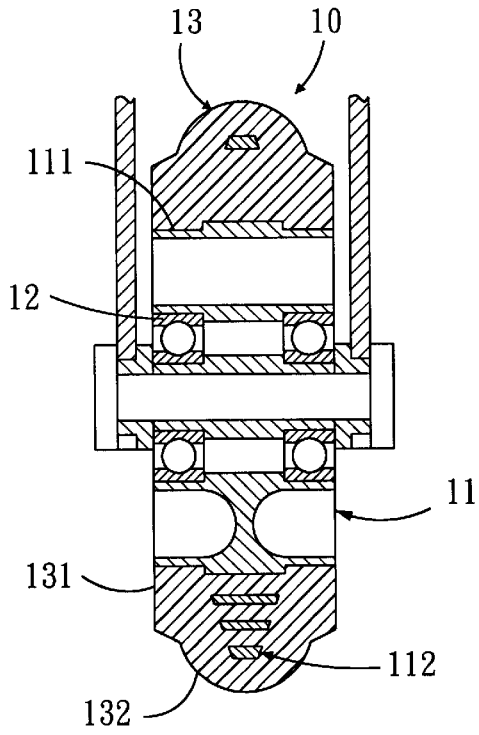
FIG. 1 PRIOR ART
FIG. 1 is a sectional view of a conventional in-line roller skate wheel with a solid tire.
Figure 2:
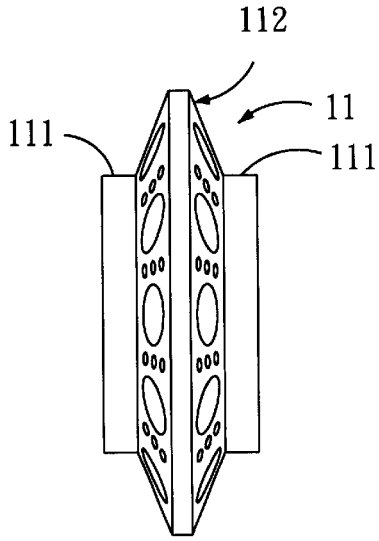
FIG. 2 PRIOR ART
FIG. 2 is a perspective view of a hub of the wheel of FIG. 1.
Figure 3:
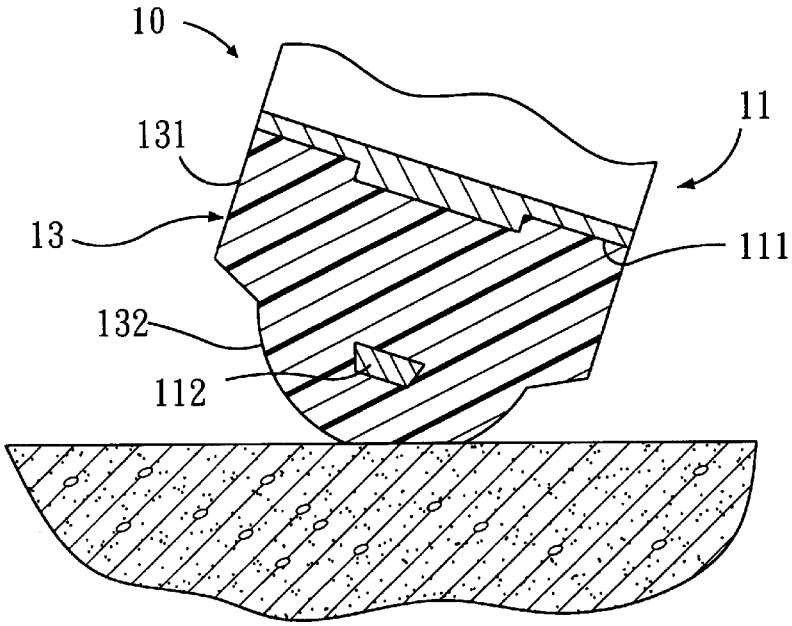
FIG. 3 PRIOR ART
FIG. 3 is a fragmentary sectional view to illustrate how the tire of the wheel of FIG. 1 flattens when a skater slightly tips the wheel and pushes against the ground.
Figure 4:
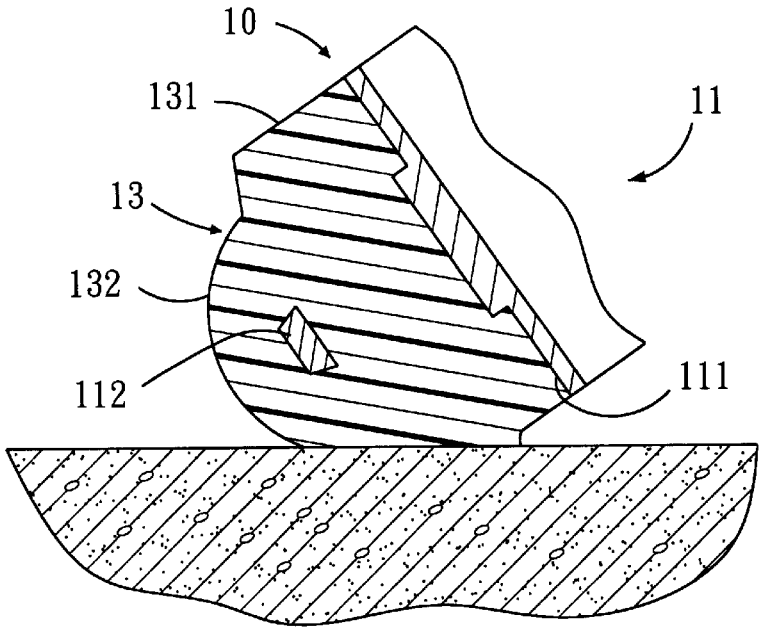
FIG. 4 PRIOR ART
FIG. 4 is a fragmentary sectional view to illustrate how the tire of the wheel of FIG. 1 flattens when the skater sharply tips the wheel and pushes against the ground.

For the sake of brevity, like elements are denoted by the same reference numerals throughout the disclosure.

Figure 5:
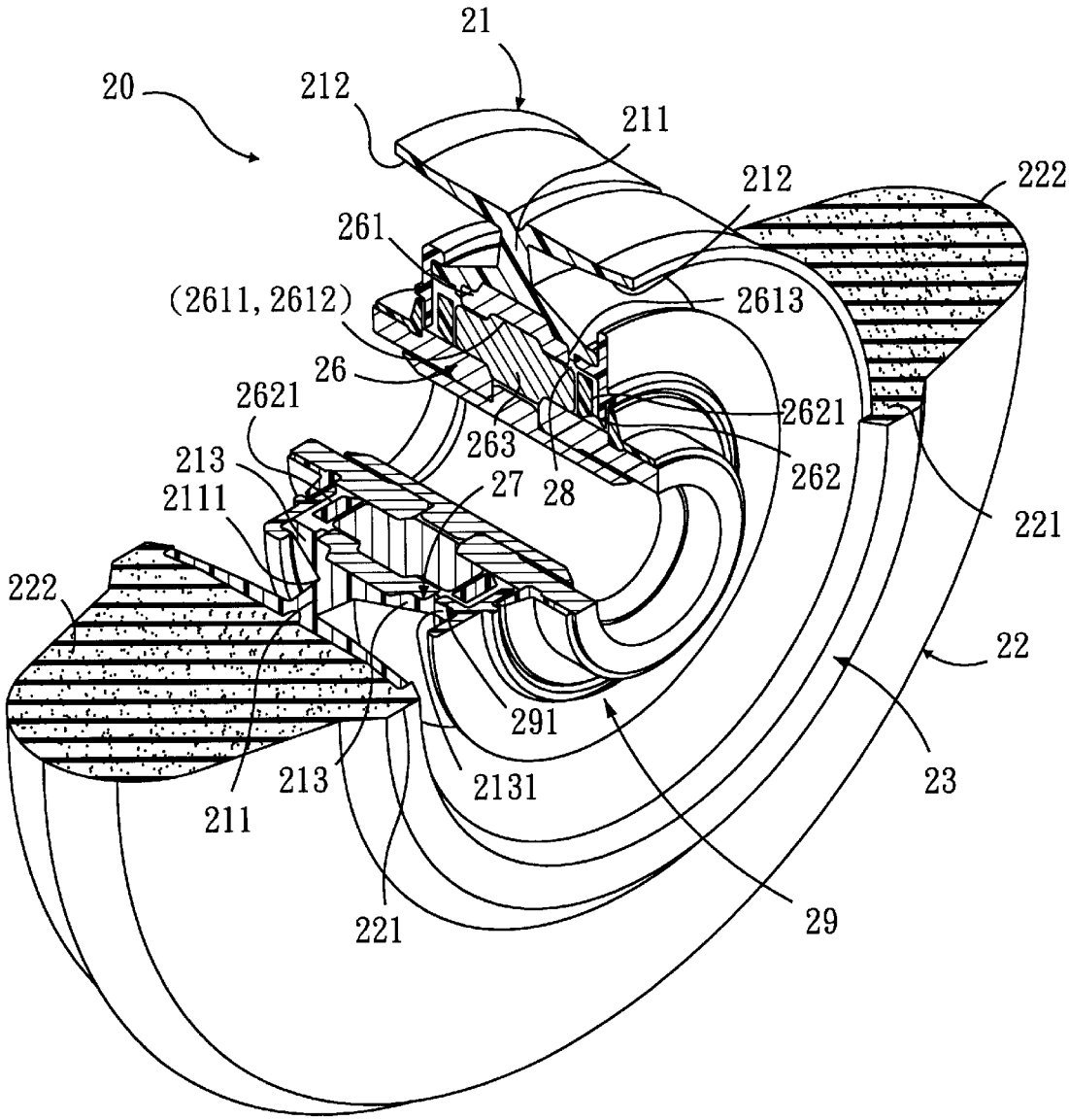
FIG. 5 is a fragmentary perspective cutaway view of a preferred embodiment of a wheel for an in-line skate of this invention with a solid tire.
Figure 6:
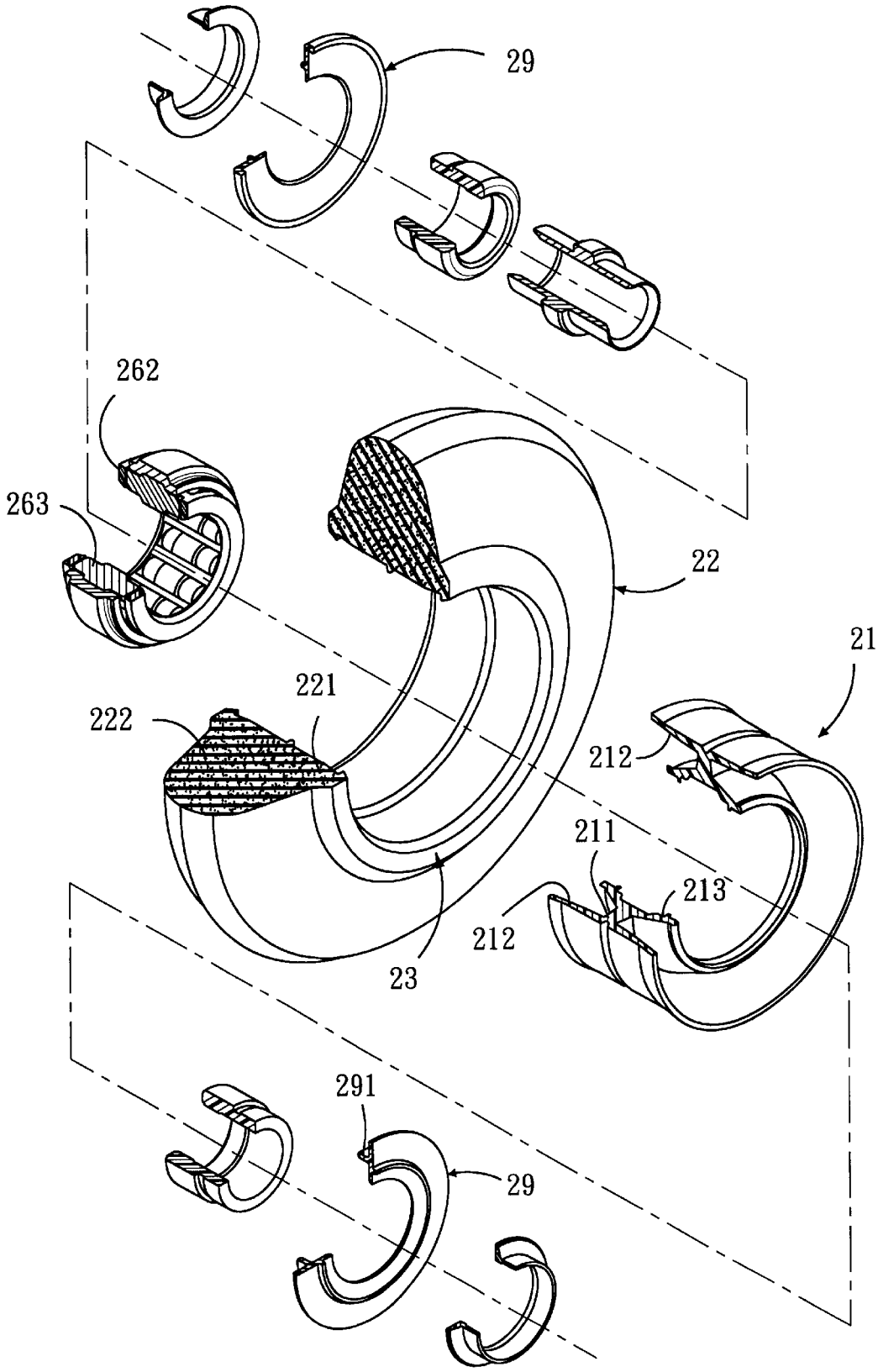
FIG. 6 is an exploded perspective view of the wheel of FIG. 5.
Figure 7:
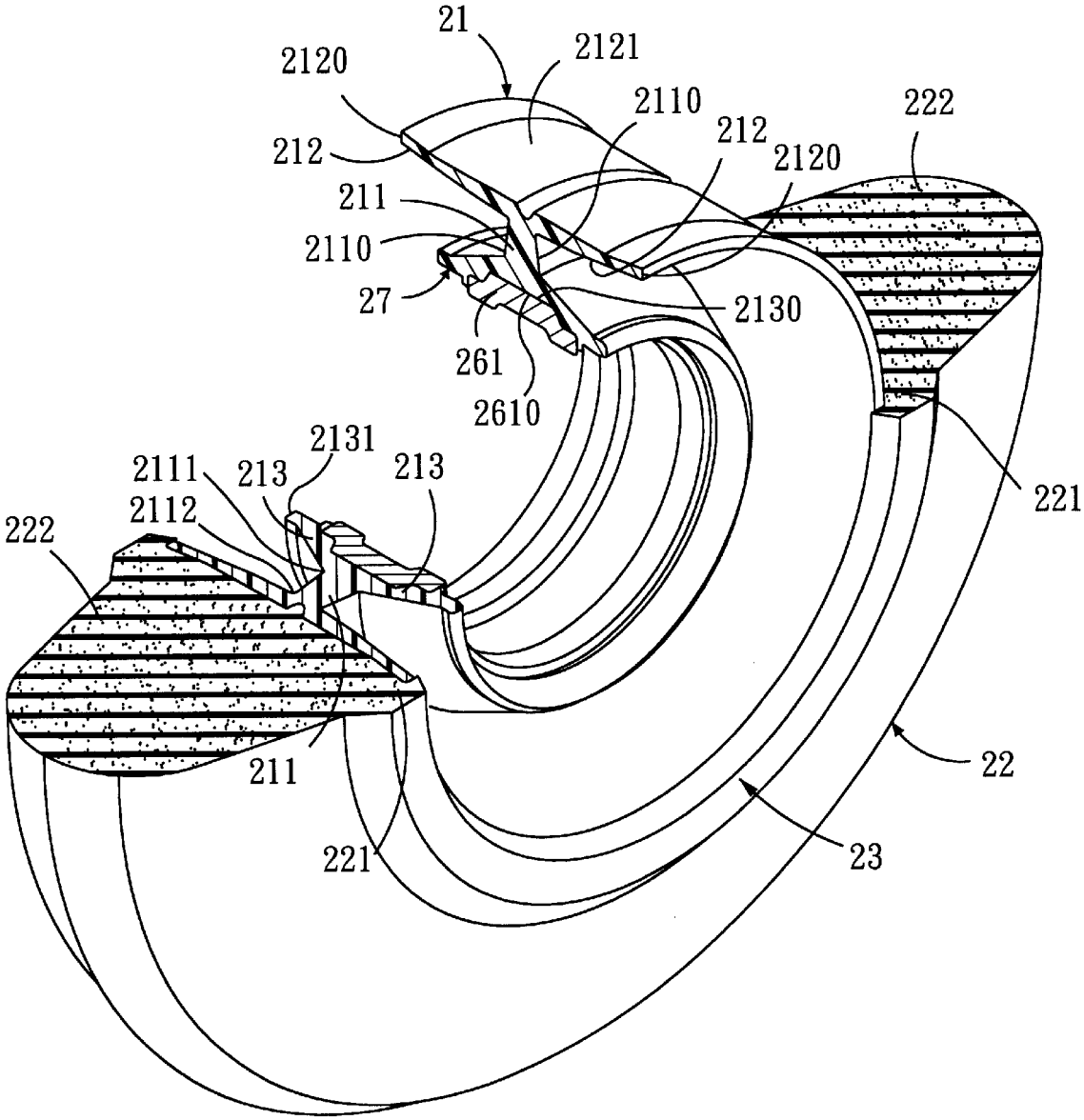
FIG. 7 is a fragmentary perspective cutaway view of the wheel of FIG. 5 without the bearing.

FIGS. 5 to 7 illustrate a first preferred embodiment of the wheel 20 of this invention for an in-line skate.

Figure 8:
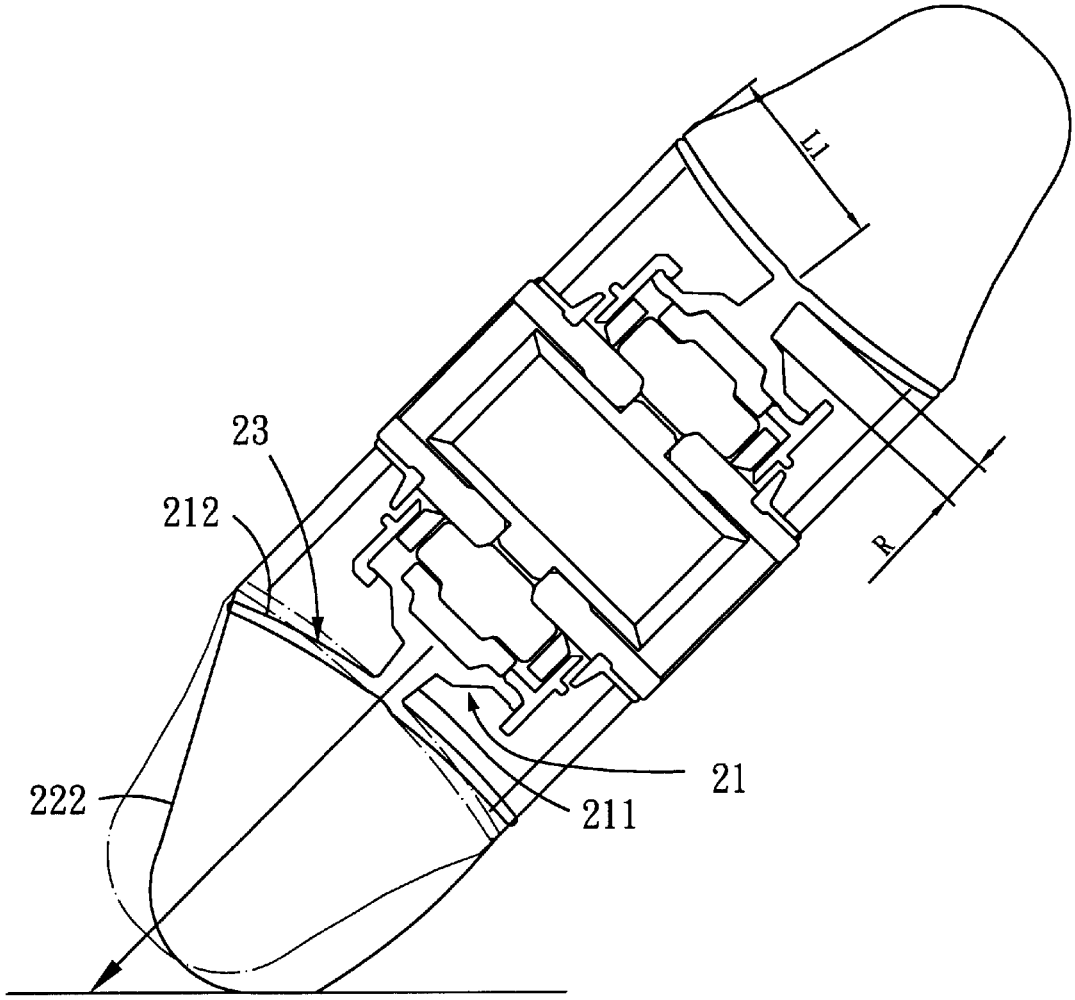
FIG. 8 is a sectional view to illustrate how an outer rim fulcrums about a central stem and the tire of the wheel of FIG. 5 bends when a skater tips the wheel and pushes against the ground.

The wheel 20 includes: a ring-shaped hub 21 having a ring-shaped radially extending central stem 211 that has two opposite axial sides 2110 and radial inner and outer ends 2111, 2112, two symmetrical ring-shaped upper wings 212 that extend oppositely and sidewisely from the radial outer end 2112, and two symmetrical ring-shaped lower wings 213 that extend oppositely and sidewisely from the radial inner end 2111, each of the upper wings 212 having an annular free end 2120 and an annular outer surface 2121 which extends sidewisely from the central stem 211 to the free end 2120; and a ring-shaped solid tire 22 having a hub connecting ring portion 221 that securely embraces and that radially and outwardly extends relative to the outer surfaces 2121 of the upper wings 212. The tire 22 further has a ground engaging ring portion 222 that axially reduces and that radially and outwardly extends from the hub connecting ring portion 221, and that has a radial thickness greater than that of the hub connecting ring portion 221. The hub connecting ring portion 221 cooperates with the upper wings 212 to form an outer rim 23 of the wheel 20 that is capable of fulcruming about the central stem 211 so as to permit bending of the ground engaging ring portion 222 toward one of the opposite axial sides 2110 of the central stem 211 when the wheel 20 tips toward said one of the opposite axial sides 2110 of the central stem 211 and pushes against the ground. As illustrated in FIG. 8, the upper wings 212 fulcrum about the central stem 211 in a clockwise direction, and the ground engaging ring portion 222 of the tire 22 bends toward a left-hand side of the drawing, i.e., the left-hand side of the ground engaging ring portion 222 is stretched at the actual elasticity module, of the right-hand side of the ground engaging ring portion 222 that deforms the tire under pressure. The bending of the tire 22 deforms the tire under tension and that has far less influence on the incremental stiffness. The fulcruming of wings 212 adds to the incremental deformation of tire 22, keeping its incremental stiffness at bay and preserve the rebound ability. The taking over of, especially the deformation by pressure of the tire 22, of the wings 212, 213 of the wheel 20 not only prevents the tire 22 from becoming less effective in rebounding, but adds continuation of the rebound capacity of a system formed by tire 22 and wings 212, significantly reduces the conflicting contact diameters with respect to the ground, conserve the capability of the wheel 20 to resiliently store and return motion of the wheel 20, thereby eliminating the aforesaid drawbacks as encountered in the prior art. Each of the upper wings 212 has an axial length (L1) (see FIG. 8) The central stem 211 has a radial thickness (R) that is less than the axial length (L1) of each of the upper wings 212.

Figure 9:
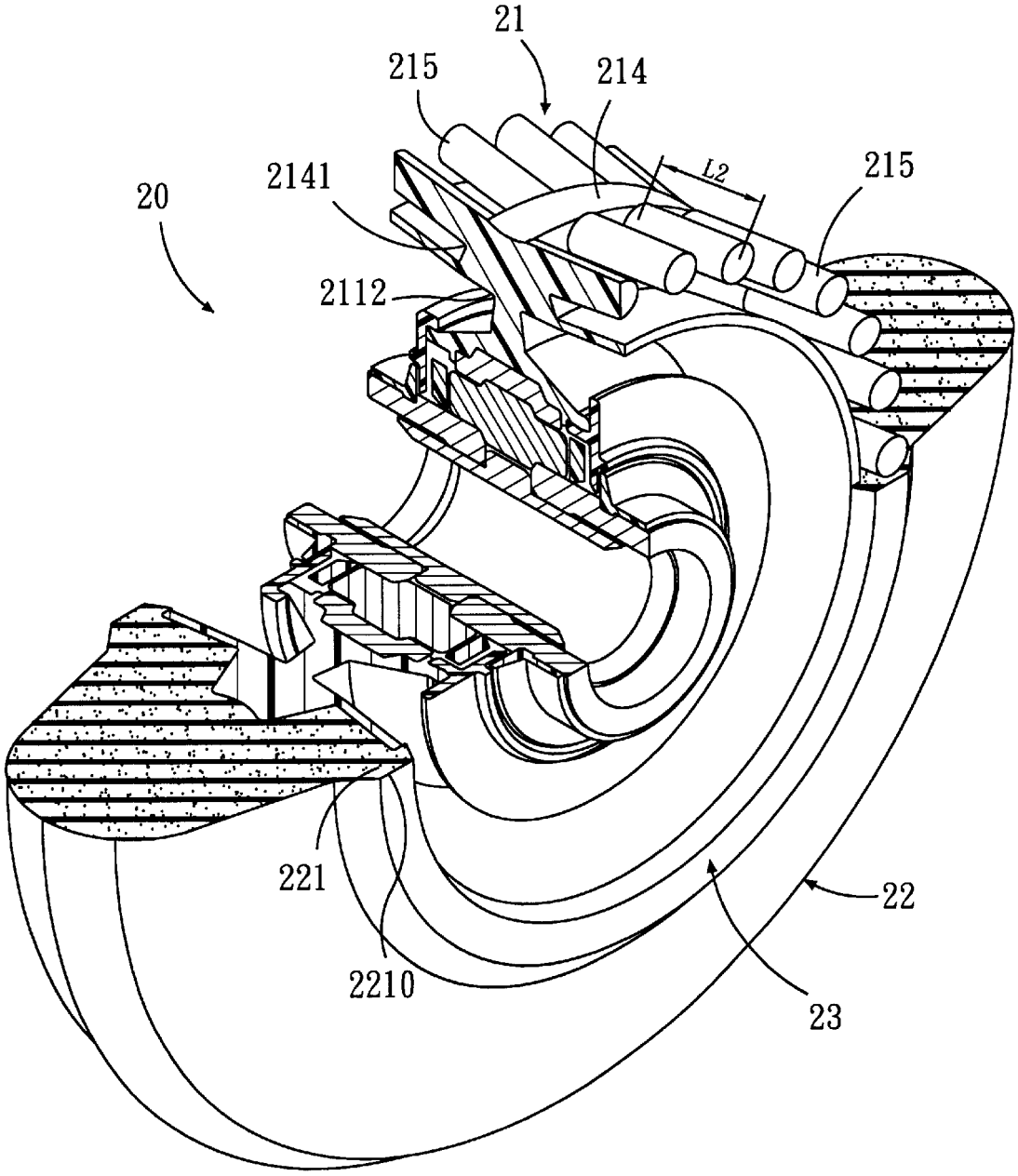
FIG. 9 is a fragmentary perspective cutaway view to illustrate a second preferred embodiment of the wheel of this invention.

Referring now to FIG. 9, a second preferred embodiment of the wheel 20 of this invention is shown. As compared to the embodiment of FIG. 5, the hub 21 of this embodiment further includes a ring-shaped ridge 214 that extends radially and outwardly from the radial outer end 2112 of the central stem 211 and that has a radial top end 2141 opposite to the radial outer end 2112 of the stem 211, and a plurality of angularly disposed cylindrical first and second ribs 215 that extend oppositely and sidewisely from the radial top end 2141 of the ridge 214. The ridge 214 and the first and second ribs 215 are encapsulated by the hub connecting ring portion 221 of the tire 22 so as to enhance bonding strength between the tire 22 and the hub 21. Each of the first and second ribs 215 has an axial length (L2) that is greater than those of the upper wings (L1) (see FIG. 9).

The hub connecting ring portion 221 of the tire 22 has two opposite axial side ends 2210. The free end 212 of each of the upper wings 212 is disposed adjacent to a respective one of the opposite axial side ends 2210 of the hub connecting ring portion 221.

Figure 10:
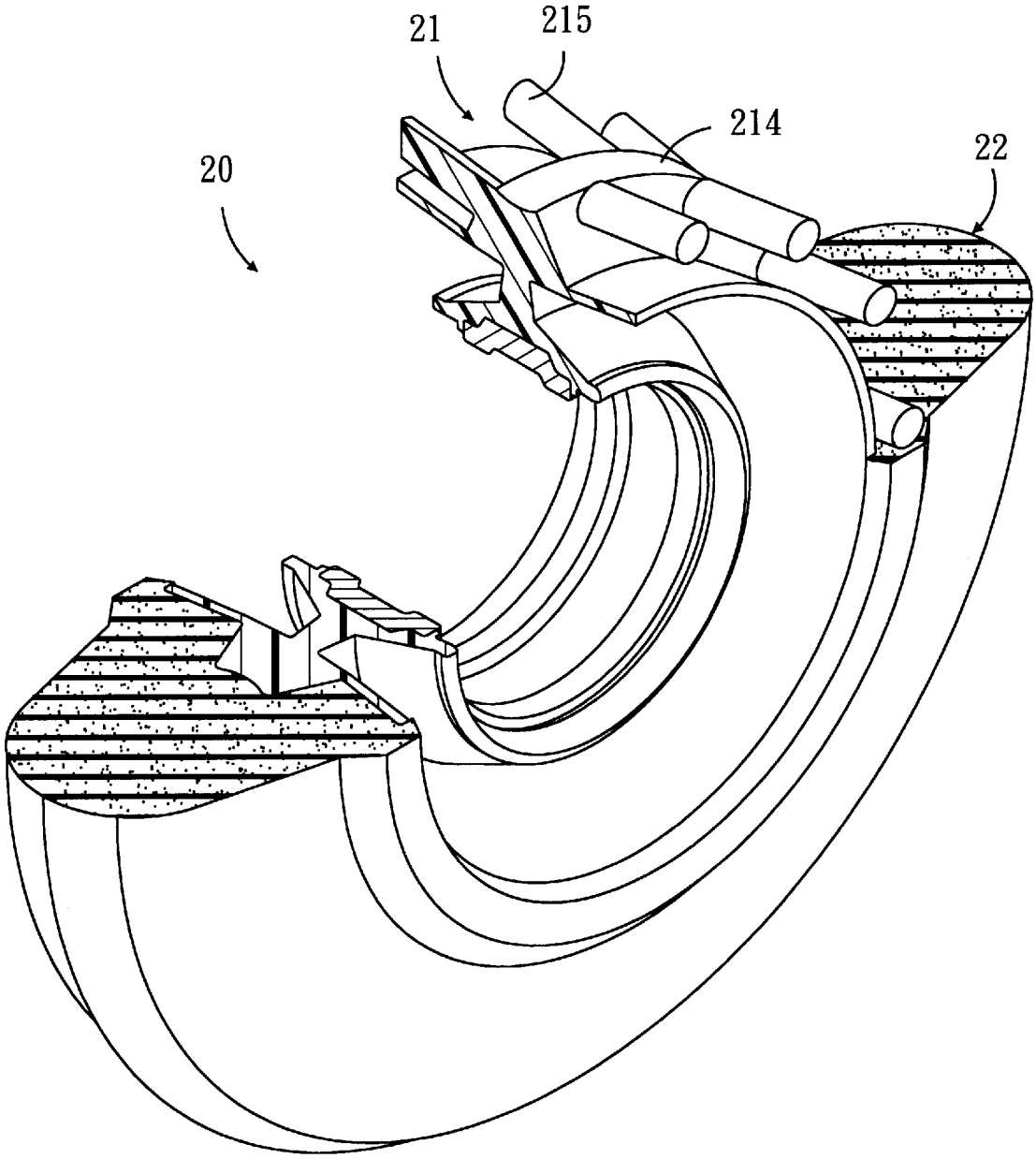
FIG. 10 is a fragmentary perspective cutaway view to illustrate a third preferred embodiment of the wheel of this invention.

FIG. 10 illustrates a third preferred embodiment of the wheel 20 of this invention, which is similar to the embodiment of FIG. 9, except that the first and second ribs 215 are alternately disposed in an angular direction along the ridge 214 instead of being symmetrically aligned.

The tire 22 and the hub 21 are preferably made from polymeric materials, such as rubbers, polyurethane, thermoplastics, and elastomers. In the first embodiment, the tire 22 and the hub 21 are made from compatible polyurethanes. In the second and third embodiments, the tire 22 is made from polyurethane, whereas the hub 21 is made from a thermoplastic material that is noncompatible with polyurethane.

Referring once again to FIGS. 5 to 7, a bearing 26 includes a rigid outer race 261 which has an annular outer surface 2610. The lower wings 213 have annular inner surfaces 2130 that securely embrace the outer surface 2610 of the outer race 261 and that cooperate with the outer race 261 to form an inner rim 27 of the wheel 20. The inner rim 27 is connected to the outer rim 23 via the central stem 211, and is rigid relative to the outer rim 23 so as to permit the outer rim 23 to be capable of fulcruming about the central stem 211.

The outer race 261 of the bearing 26 further has an annular inner surface 2611 that is opposite to the outer surface 2610 and that confines a ring-receiving bore 2612. The bearing 26 further includes an annular cage 262 with a plurality of rollers 263 that are enclosed by and that are in rolling contact with the inner surface 2611 of the outer race 261. The outer race 261 has two opposite axial ends 2613. The cage 262 has two opposite axial ends 2621 that project axially and outwardly relative to the axial ends 2613 of the outer race 261, respectively. The lower wings 213 have annular free ends 2131 that project axially and outwardly relative to the axial ends 2613 of the outer race 261, respectively, and that cooperate with the axial ends 2621 of the cage 262 to define two opposite annular gaps 28 thereamong. The wheel 20 further includes a pair of annular covering caps 29, each of which has an annular flange 291 that projects axially therefrom and that is fittingly received in a respective one of the gaps 28 so as to cover the gaps 28 and so as to prevent entry of dust into the bearing 26.

With the invention thus explained, it is apparent that various modifications and variations can be made without departing from the spirit of the present invention. It is therefore intended that the invention be limited only as recited in the appended claims.

I claim:

1. A wheel for an in-line skate, said wheel comprising:

a ring-shaped hub having a ring-shaped radially extending central stem that has two opposite axial sides and radial inner and outer ends, two symmetrical ring-shaped upper wings that extend oppositely and sidewisely from said radial outer end, and two symmetrical ring-shaped lower wings that extend oppositely and sidewisely from said radial inner end, each of said upper wings having an annular free end and an annular outer surface which extends sidevisely from said central stem to said free end; and a ring-shaped solid tire having a hub connecting ring portion that securely embraces and that radially and outwardly extends relative to said outer surfaces of said upper wings, said tire further having a ground engaging ring portion that axially reduces and that radially and outwardly extends from said hub connecting ring portion, and that has a radial thickness greater than that of said hub connecting ring portion, said hub connecting ring portion cooperating with said upper wings to form an outer rim of said wheel that is capable of fulcruming about said central stem so as to permit bending of said ground engaging ring portion toward one of said opposite axial sides of said central stem when said wheel tips toward said one of said opposite axial sides of said central stem and pushes against the ground;

wherein said hub further has a ring-shaped ridge that extends radially and outwardly from said radial outer end of said central stem and that has a radial top end opposite to said radial outer end of said stem, and a plurality of angularly disposed first and second ribs that extend oppositely and sidewisely from said radial top end of said ridge, said ridge and said first and second ribs being encapsulated by said hub connecting ring portion of said tire so as to enhance mechanical strength of said outer rim.

2. The wheel of claim 1, wherein each of said upper wings has an axial length, said central stem having a radial thickness that is less than said axial length of each of said upper wings.

3. The wheel of claim 1, wherein each of said first and second ribs has an axial length that is greater than those of said upper wings.

4. The wheel of claim 3, wherein said hub connecting ring portion of said tire has two opposite axial side ends, said free end of each of said upper wings being disposed adjacent to a respective one of said opposite axial side ends of said hub connecting ring portion.

5. The wheel of claim 4, wherein said tire and said hub are made from polymeric material.

6. The wheel of claim 1, further comprising a bearing that includes a rigid outer race which has an annular outer surface, said lower wings having annular inner surfaces that securely embrace said outer surface of said outer race and that cooperate with said outer race to form an inner rim of said wheel that is rigid relative to said outer rim so as to permit said outer rim to be capable of fulcruming about said central stem.

7. The wheel of claim 6, wherein said outer race further has an annular inner surface that is opposite to said outer surface and that confines a ring-receiving bore, said bearing further including an annular cage with a plurality of rollers that are enclosed by and that are in rolling contact with said inner surface of said outer race, said outer race having two opposite axial ends, said cage having two opposite axial ends that project axially and outwardly relative to said axial ends of said outer race, respectively, said lower wings having annular free ends that project axially and outwardly relative to said axial ends of said outer race, respectively, and that cooperate with said axial ends of said cage to define two opposite annular gaps thereamong, said wheel further comprising a pair of annular covering caps, each of which has an annular flange that projects axially therefrom and that is fittingly received in a respective one of said gaps so as to cover said gaps.

* * * * *